United States Patent [19]

Crane et al.

[11] Patent Number: 4,766,631

[45] Date of Patent: Aug. 30, 1988

[54] SEWER PIPELINE HYDRAULIC ROOT CUTTER APPARATUS

[75] Inventors: Patrick R. Crane, Calabasas; Donald J. Bell, Northridge, both of Calif.

[73] Assignee: Sewer Rodding Equipment Company, Lima, Ohio

[21] Appl. No.: 91,912

[22] Filed: Sep. 1, 1987

[51] Int. Cl.[4] ..... B08B 9/02

[52] U.S. Cl. ..... 15/104.12; 15/104.31

[58] Field of Search ..... 15/104.09, 104.12, 104.13, 15/104.14, 104.3 R; 134/167 C, 168 C

[56] References Cited

U.S. PATENT DOCUMENTS

| | | | |
|---|---|---|---|
| 3,449,783 | 6/1969 | Kirschke | 15/104.12 |
| 3,525,112 | 8/1970 | Masters | 15/104.31 |
| 3,740,785 | 6/1973 | Latall | 15/104.12 |
| 4,516,286 | 5/1985 | Crane | 15/104.31 |

*Primary Examiner*—Edward L. Roberts

*Attorney, Agent, or Firm*—David O'Reilly

[57] ABSTRACT

A sewer pipeline root cutting apparatus having entirely internal fluid passageways and interchangeable skids. A hydraulically driven motor drives a shaft for attachment of a cutting tool at one end, and has a thrusting nozzle connecting a high pressure hose at the other end. The system is arranged so that the high pressure thrusting nozzle connector holds the interchangeable skid assemblies on the hydraulic motor housing in use. The interchangeable skid assemblies are easily exchanged by simply removing the thruster nozzle and replacing the skid assembly, allowing the pipeline cleaner to be adapted to pipelines only slightly larger than the apparatus up to some of the largest sewer lines.

4 Claims, 3 Drawing Sheets

SEWER PIPELINE HYDRAULIC ROOT CUTTER APPARATUS

FIELD OF THE INVENTION

This invention relates to a sewer pipeline hydraulic root cutter and more particularly relates to a hydraulically driven sewer pipeline root cutter adaptable to a wide variety of pipeline sizes.

BACKGROUND OF THE INVENTION

Sewer pipeline root cutters are known in the art and are a sewer pipeline cleaning device which is pushed through a sewer line while a cutting tool is rotated to clean away roots, or other debris that may clog the line. A variety of methods are used to drive the root cutting tool.

One device has a hydraulic motor, called a gerotor, with the cleaning tool or root cutter being attached to the motor drive shaft. Such devices are disclosed and described in U.S. Pat. No. 3,740,875, issued in June of 1973 to Latall and, U.S. Pat. No. 4,516,286, issued in May of 1985 to Crane. In these devices the motor is driven by fluid under high pressure connected to the motor through a jet thruster secured to the motor casing. The jet thruster is provided with a blind socket which applies the fluid to the inlet to the motor while simultaneously causing the fluid to apply a thrust to the sewer cleaning apparatus. A disadvantage of these prior devices is that have externally connected pipes and tubing which can be damaged, or become clogged during use.

The purpose of the present invention; therefore, is to provide a simplified more compact construction for a sewer pipeline cleaning and root cutting apparatus.

Still another object of the present invention is to provide a sewer pipeline root cutting hydraulic motor adaptable to a wide range of pipeline diameters.

Still another object of the present invention is to provide a sewer pipe line cleaning apparatus having completely internal hydraulic lines to avoid external pipes and tubing.

Yet another object of the present invention is to provide a sewer pipeline cleaning and root cutting apparatus in which pipeline skids are easily interchangeable to adapt the motor to pipes from four inches to fifteen inches in diameter.

BRIEF DESCRIPTION OF THE INVENTION

The purpose of the present invention is to improve the sewer pipeline cleaning apparatus disclosed and described in U.S. Pat. No. 4,516,286, referred to hereinabove and incorporated herein by reference. In the latter patent a pipeline cleaner gerotor for driving a sewer cleaning and cutting tool is described having a motor connected to a nozzle on a frame which incorporates skids. Fluid is delivered to the motor through a high pressure base to pipes and tubing and exhausted through a conduit.

In the present invention the drive motor is made more compact by incorporating the tubing and fluid conduits inside the motor housing eliminating the need for external tubing. The forward end of the hydraulic drive motor includes permanently attached skids for fitting the apparatus into the smallest diameter sewer pipelines only slightly larger than the diameter of the motor. A thruster nozzle is threaded on the rear end of the motor and has a shoulder for securing interchangeable skids on the motor to adapt the motor to a wide variety of pipeline diameters. Interchangeability is provided by simply removing the thruster nozzle and sliding a larger diameter skid frame over the motor and then replacing the thruster nozzle. The thruster nozzle itself serves to hold the skids on the motor assembly without any additional bolts or fastening means.

A high pressure fluid hose is connected to thruster nozzle at one end and a sewer cleaning tool, such as a root cutter, may be attached to the hydraulic motor drive shaft at the opposite end. The tool is driven by the high pressure of the fluid delivered through the high pressure hose which rotates the tool as the sewer cleaning apparatus is pushed through a pipeline by advancing the hose and by the rearward thrust of the thruster nozzle. The fluid connecting thruster nozzle has rearwardly facing orifices which produce the rearward a thrust to assist in pushing the sewer pipeline cleaning apparatus through the pipe being cleaned.

The hydraulic motor is supported in the pipeline in a frame forming a skid assembly. The skid assembly is mounted on the hydraulic motor by removing the thrust nozzle and sliding the skid assembly over the outer circumference of the motor. Replacement of the nozzle secures the skid assembly to the motor. In this manner the skids may be easily interchanged or the motor removed from the skid assembly for maintenance, repair or replacement, without the necessity of removing any parts.

The interchangeable skids maintain the hydraulic motor and root cutter substantially centered in the pipeline while being pushed through for cleaning. Skids for the smallest pipeline to be cleaned are permanently attached to a plate in the forward end of the hydraulic motor.

The above objects, advantages and other novel features of the invention will be more fully understood from the following detailed description and the accompanying drawings, in which:

DETAILED DESCRIPTION OF THE INVENTION

Figure 1:
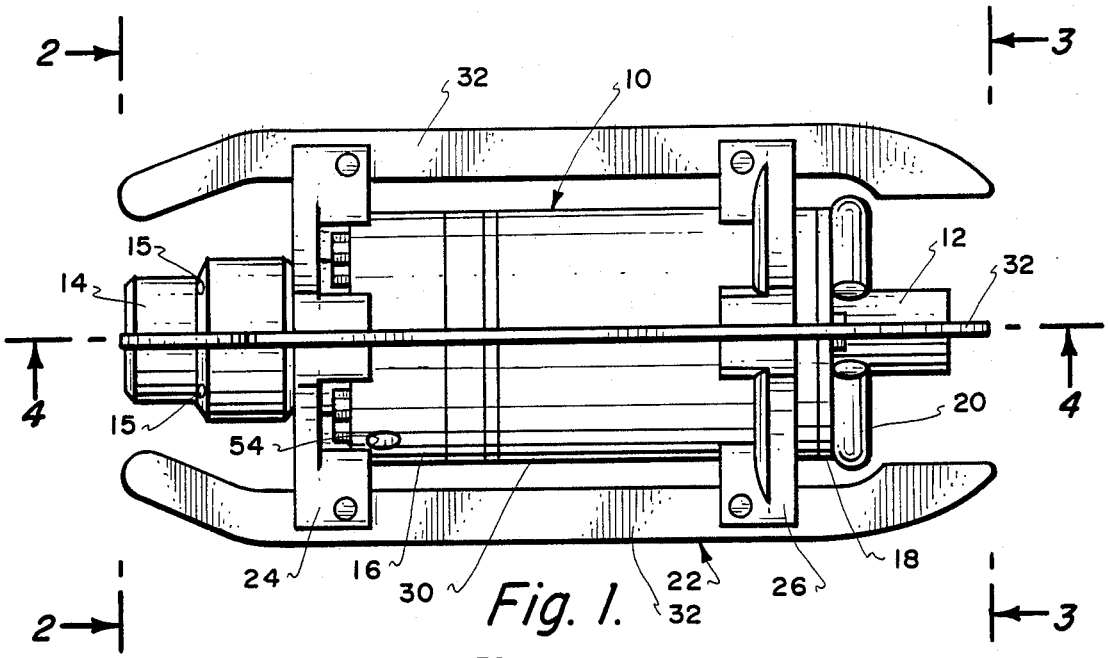
FIG. 1 is a side elevation of a sewer pipeline cleaning apparatus constructed according to the invention.

A Hydraulic Sewer Pipeline Cleaning Apparatus according to the invention is illustrated in FIG. 1 and is comprised of a hydraulic motor 10, called a gerotor, having a drive shaft 12 at one end and a thruster nozzle 14 connected to end cap 16 at the other end. A skid ring 18 having arcuate skids 20 is permanently attached to the forward end of the hydraulic motor 10 for use in the smallest of sewer pipelines. An interchangeable skid assembly 22 is held in place on the hydraulic motor 10 by thruster nozzle 14, as will be described in greater detail hereinafter.

Figure 2:
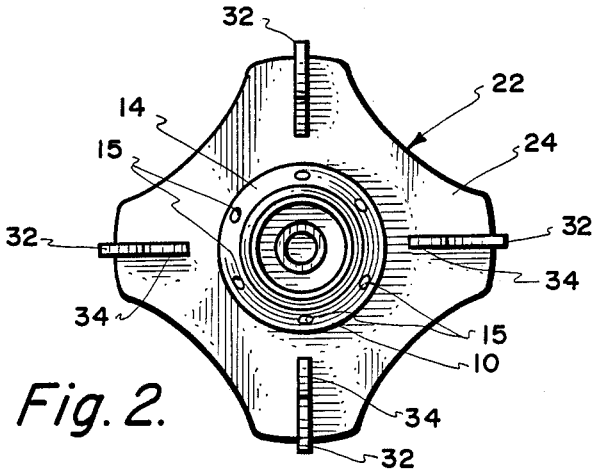
FIG. 2 is a rear view of the hydraulic sewer pipeline cleaning apparatus, taken at 2—2 of FIG. 1.
Figure 3:
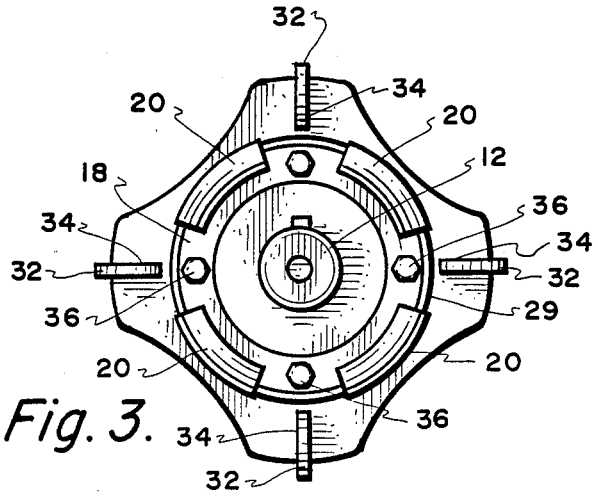
FIG. 3 is a front view of the hydraulic sewer pipeline cleaning apparatus, taken at 3—3 of FIG. 1.

The rear and forward end views respectfully illustrated in FIGS. 2 and 3 show the arrangement of the skid assemblies on hydraulic motor 10. The interchangeable skid assembly 20 is comprised of forward and rear spiders 24 and 26 having apertures 28 fitting the outer diameter of the housing portion 30 and boss on end cap 16 of hydraulic motor 10. Runners 32 are securely fastened in slots 34 in the respective spider assemblies 24, 26 completing skid assembly 22. A smaller diameter pipe skid assembly is comprised of ring 18 secured to the forward end of hydraulic motor housing 30 by bolts 36 having arcuate steel skids 20 spaced around ring 18 securely fastened by welding. This skid assembly can remain on the hydraulic motor 10 when interchangeable skid assemblies 22 for pipe sizes up to fifteen inches are exchanged.

Skid assembly 22 is secured and held in place on the hydraulic motor 10 by thrusting nozzle 14. Skid assembly 22 is mounted by aperture 28 in spider 24 sliding over threaded extension or boss 36 on end cap 16 and is secured by thruster nozzle 14 being threaded onto extension 36. In this manner different size skid assemblies 22 can be mounted on motor 10. Thus, the motor can be easily changed for use in pipes from four inch up to fifteen inch by simply removing thruster nozzle 14 sliding a new skid assembly 22 over motor 10 and reattaching thruster nozzle 14. It is a quick and simple operation requiring a minimum of tools.

Thruster nozzle 14 is provided with thrusting ports 15 applying a backward thrust to help push the motor and cutting tool connected to drive shaft 12 through a sewer pipeline. Threads 38 in thruster nozzle 14 receive a fitting 40 for attaching a high pressure hose to deliver water at high pressure to hydraulic motor 10.

End cap 16 and motor housing 30 are constructed to eliminate any external conduits or tubing. Fluid delivered to thruster nozzle 14 enters motor housing 30 through passageways 43, 44 and 46 in end cap 16. Bolts 17 secure end cap 16 to housing 30 with passageway 46 aligned with passageway 48 in hydraulic motor 10 to deliver fluid from thruster nozzle 14 to drive the motor. Fluid is exhausted from motor 10 through exhaust port 50. This construction provides an entirely internal delivery system without any external connectors tubes or couplings which could be damaged during use.

Figure 5:
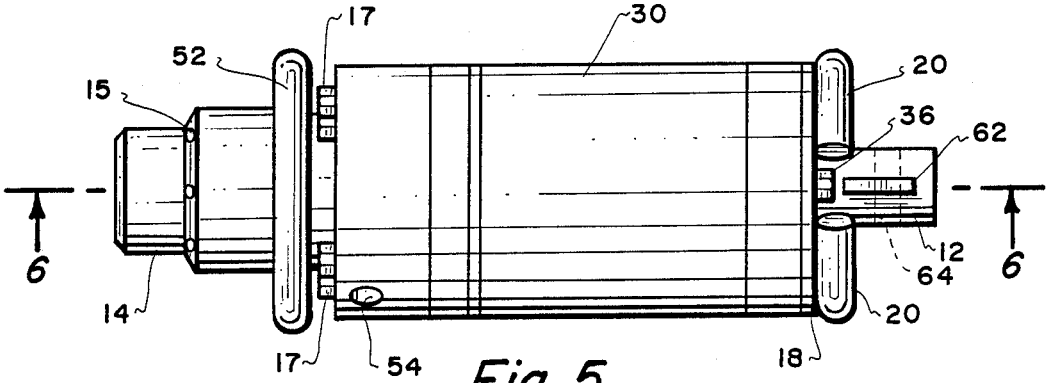
FIG. 5 is a side elevation of a hydraulic sewer pipeline cleaning apparatus arrangement for use in the smallest diameter pipes.
Figure 6:
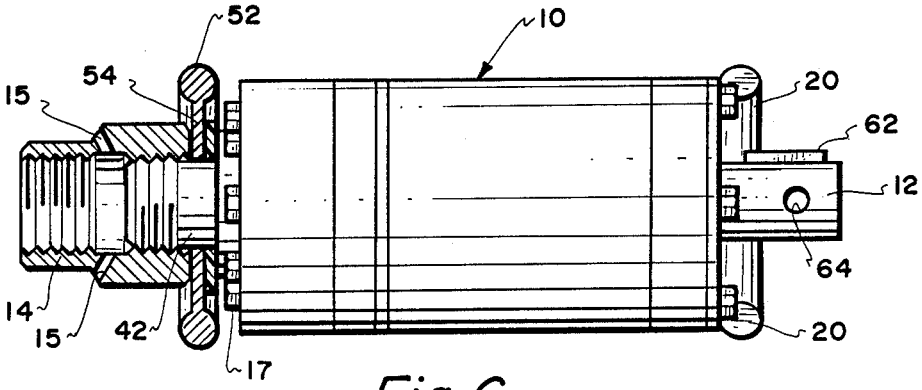
FIG. 6 is a partial section of the embodiment of FIG. 5, taken at 6—6 of FIG. 5.

The construction of the skid mounting arrangement for the smallest of pipelines only slightly larger than the hydraulic motor is illustrated in the drawings of FIGS. 5 and 6. Skids 20 are provided on a circular ring 18 permanently bolted to the forward end of motor housing 30. A rear skid is provided in the form of a donut shaped ring 52 welded to the periphery of circular plate 54. The system is assembled for the smallest diameter sewer pipelines by removing thruster nozzle 14 and sliding plate 54 over threaded boss 42. Thruster nozzle 14 is then rethreaded on threaded boss or extension 42 securely clamping skid 52 to motor 10. Spanner hole 54 is provided to tightly hold the motor 10 while thruster nozzle 14 is being reattached using the minimum tools.

Figure 4:
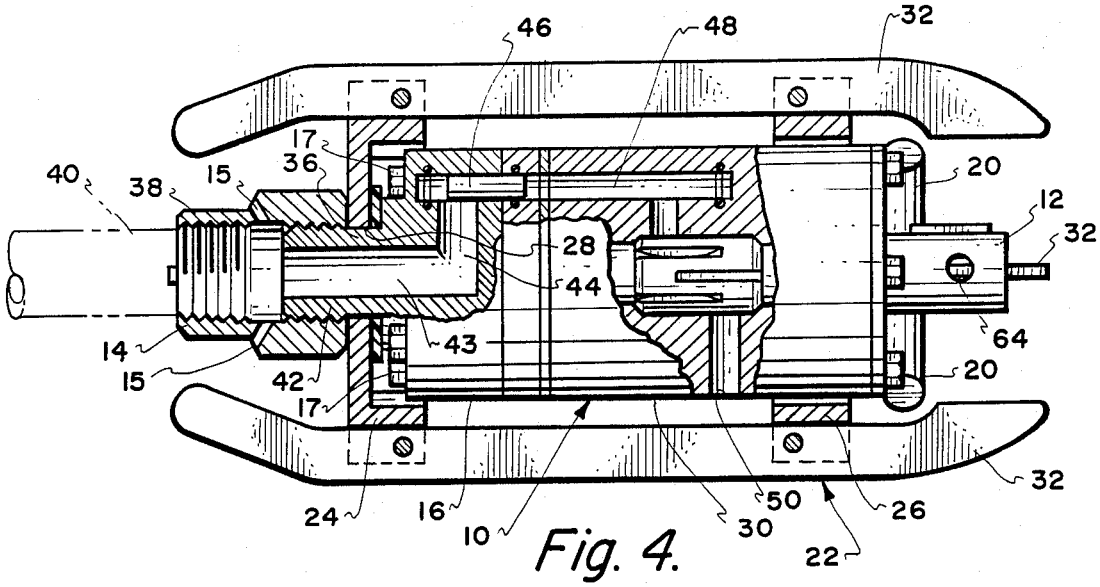
FIG. 4 is a side elevation in partial section illustrating the flow of hydraulic fluid to the sewer pipeline hydraulic motor, taken at 4—4 of FIG. 1.
Figure 7:
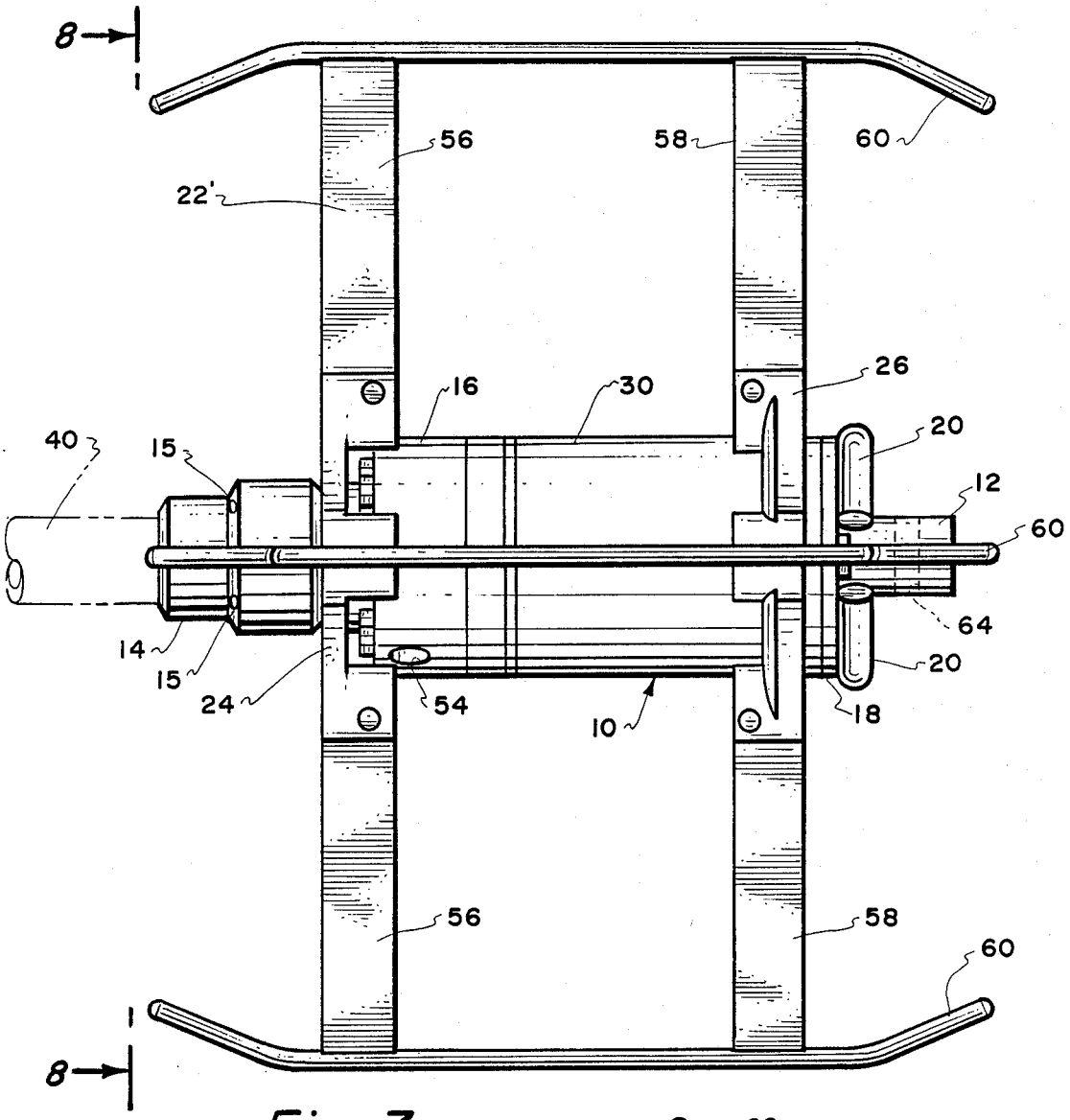
FIG. 7 is a side elevation of the hydraulic sewer pipeline cleaning apparatus according to the invention with an interchangeable skid for larger pipelines.
Figure 8:
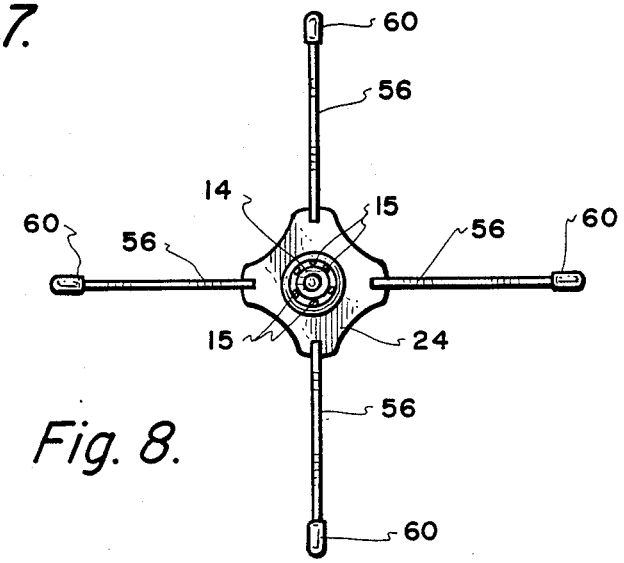
FIG. 8 is a end view, taken at 8—8 of FIG. 7 in smaller scale.

Skid assembly 22′ for larger diameter pipelines is illustrated in FIGS. 7 and 8. Skid assembly 22′ uses the same spider 24 and 26 as before. However, inserted and secured in slots 34 (FIG. 2) are extending arms 56 and 58 with cylindrical round spring steel skids 60 securely fastened to their outboard ends. Skid assembly 22 for intermediate size pipelines is interchangeable with skid assembly 22′ for large pipeline assemblies and is easily exchanged. As is shown in FIG. 4 the skid assembly may be changed by simply removing thruster nozzle 14 and sliding skid assembly spider 24 over the end of tubular extension or boss 42. Reattachment of thruster nozzle 14 securely fastens the skid assembly on the motor. No bolts or other fasteners are needed to hold the skid assembly around motor housing 30. The forward thrust on thruster nozzle 14 pushes motor, cutting tool and skid assembly forward through a sewer pipeline assisted by the backward thrust of fluid existing ports 15.

In use a suitable cutting tool is fastened to the end of drive shaft 12 and a high pressure hose 40 is attached to thruster nozzle 14. The sewer pipeline cleaning assembly is then inserted in a pipeline to be cleaned and water at high pressure applied to high pressure hose 40. The high pressure fluid, or water, enters motor 10 through end cap 16 to rotate the drive shaft 12 and cutter (not shown) and then exits through port 50. The cutting tool has a shank fitting key 62 and is bolted to drive shaft 12 by a bolt passing through hole 64 in the drive shaft.

Thus, there has been described a novel sewer pipeline cleaner and root cutting apparatus which is compact in design and adaptable to a wide range of pipeline diameters. The cutting tool attached to the drive shaft of the cleaning apparatus can be appropriately sized according to the size of the skid assembly mounted on the hydraulic motor which are easily interchanged. All external conduits and couplings are eliminated.

This invention is not to be limited by the embodiment shown in the drawings and described in the description which is given by way of example and not of limitation, but only in accordance with the scope of the appended claims.

What is claimed is:

1. In a sewer pipeline cleaning apparatus having a hydraulic motor with a drive shaft, an inlet for connecting a high pressure hydraulic fluid to drive a sewer cleaning tool attached to said drive shaft the improvement comprising:

a hydraulically driven motor having a drive shaft on a forward end and a cap on the rearward end;

passageway means in said end cap for delivering fluid under high pressure to said hydraulically driven motor to operate said drive shaft;

thrusting nozzle means detachably mounted on said end cap for connecting a high pressure fluid to said hydraulically driven motor;

interchangeable skid means mounted on said hydraulically driven motor;

said interchangeable skid means being held on said hydraulically driven motor by mounting said thrusting nozzle means on said end cap;

whereby skids for different diameter sewer pipelines may exchanged easily by removing said thrusting nozzle from said end cap.

2. The apparatus according to claim 1 in which said interchangeable skid for the smallest diameter sewer pipeline comprises; a circular ring permanently attached to the forward end of said hydraulically driven motor having arcuate skids welded to said circular plate; and a removable circular skid mounted on said end cap held in place by said thrusting nozzle.

3. The apparatus according to claim 1 which said interchangeable skid means comprises; a first skid spider having an aperture fitting over said hydraulically driven motor; a second skid spider having an aperture fitting over a threaded boss on said end cap; a plurality of skids attached to said first and second spiders spaced around said hydraulically driven motor; said thrusting nozzle being threaded onto said threaded boss to hold said skid means on said hydraulically driven motor.

4. The apparatus according to claim 3 in which there are four skids equally spaced around said hydraulically driven motor.

* * * * *